US005629272A

United States Patent [19]

Nakazato et al.

[11] Patent Number: 5,629,272

[45] Date of Patent: May 13, 1997

[54] LOW PHOSPHOROUS ENGINE OIL COMPOSITIONS AND ADDITIVE COMPOSITIONS

[75] Inventors: Morikuni Nakazato, Shizuoka Prefecture; Jiro Magarifuchi, Yokohama; Yoshifumi Isozaki, Shizuoka Prefecture, all of Japan

[73] Assignee: Oronite Japan Limited, Tokyo, Japan

[21] Appl. No.: 162,681

[22] Filed: Dec. 3, 1993

Related U.S. Application Data

[63] Continuation-in-part of Ser. No. 927,906, Aug. 10, 1992, abandoned.

[30] Foreign Application Priority Data

Aug. 9, 1991 [JP] Japan ..... 3-223664
Dec. 21, 1992 [GB] United Kingdom ..... 4-356302

[51] Int. Cl.[6] ..... C10M 141/00; C10M 141/06; C10M 141/10; C10M 141/12

[52] U.S. Cl. ..... 508/185; 508/192; 508/198; 508/199; 508/376; 508/379

[58] Field of Search ..... 252/32.7 E, 47, 252/47.5, 51.5 A, 49.6; 508/185, 192, 198, 199, 376, 379

[56] References Cited

U.S. PATENT DOCUMENTS

| | | | |
|---|---|---|---|
| 2,795,548 | 6/1957 | Thomas | 252/49.6 |
| 3,876,550 | 4/1975 | Holubec | 252/47.5 |
| 3,923,664 | 12/1975 | Neuringham | 252/32.7 E |
| 3,933,659 | 1/1976 | Lyle et al. | 252/32.7 E |
| 4,032,461 | 6/1977 | Hoke | 252/46.7 |
| 4,062,785 | 12/1977 | Nibert | 252/49.6 |
| 4,125,479 | 11/1978 | Chesluk et al. | 252/33.6 |
| 4,201,684 | 5/1980 | Malec | 252/47.5 |
| 4,207,196 | 6/1980 | Sudekum | 252/47.5 |
| 4,280,916 | 7/1981 | Richards et al. | 252/33.4 |
| 4,370,248 | 1/1983 | Horodpsky et al. | 252/49.6 |
| 4,383,931 | 5/1983 | Ryu et al. | 252/32.7 E |
| 4,394,276 | 7/1983 | Small | 252/32.7 E |
| 4,394,277 | 7/1983 | Small | 252/32.7 E |
| 4,455,243 | 6/1984 | Liston | 252/49.6 |
| 4,501,678 | 2/1985 | Katayama et al. | 252/32.7 E |
| 4,505,829 | 3/1985 | Wisotsky | 252/32.7 E |
| 4,529,526 | 7/1985 | Inoue et al. | 252/32.7 E |
| 4,530,771 | 7/1985 | Nakano et al. | 252/49.6 |
| 4,563,293 | 1/1986 | Small | 252/32.7 E |
| 4,609,480 | 9/1986 | Hata et al. | 252/32.7 E |
| 4,629,576 | 12/1986 | Small | 252/32.7 E |
| 4,648,985 | 3/1987 | Thorsell et al. | 252/32.5 |
| 4,857,214 | 8/1989 | Papay et al. | 252/49.6 |
| 4,859,352 | 8/1989 | Waynick | 252/41 |
| 4,879,054 | 11/1989 | Waynick | 252/41 |
| 4,880,551 | 11/1989 | Doe | 252/47.5 |
| 4,960,528 | 10/1990 | Everett et al. | 252/32 |
| 5,028,345 | 7/1991 | Everett et al. | 252/48.6 |
| 5,102,566 | 4/1992 | Fetterman et al. | 252/32.7 E |
| 5,141,657 | 8/1992 | Fetterman et al. | 252/32.7 E |

FOREIGN PATENT DOCUMENTS

| | | | |
|---|---|---|---|
| 0024146 | 2/1981 | European Pat. Off. | C10M 1/08 |
| 0120665 | 10/1984 | European Pat. Off. | C10M 1/06 |
| 0294096 | 12/1988 | European Pat. Off. | C10M 177/00 |
| 0317354 | 5/1989 | European Pat. Off. | C10M 163/00 |
| 0528610 | 2/1993 | European Pat. Off. | C10M 141/10 |
| 0556404 | 8/1993 | European Pat. Off. | C10M 141/12 |
| 2125431 | 3/1984 | United Kingdom | C10M 1/54 |

*Primary Examiner*—Margaret Medley
*Attorney, Agent, or Firm*—Ernest A. Schaal

[57] ABSTRACT

An engine oil composition which comprises a metal-containing detergent, zinc dithiophosphate, and a boron-containing ashless dispersant dissolved or dispersed in a base oil; characterized by further containing an antiwear agent having an aliphatic amide compound and either a dithiocarbamate compound or an ester derived from a fatty acid and boric acid.

9 Claims, No Drawings

LOW PHOSPHOROUS ENGINE OIL COMPOSITIONS AND ADDITIVE COMPOSITIONS

This is a continuation-in-part of application Ser. No. 07/927,906 filed Aug. 10, 1992, now abandoned for which priority is claimed under 35 U.S.C. §119 based upon Japanese Patent Application No. 3-223664 filed Aug. 9, 1991.

Priority is claimed for this application under 35 U.S.C. §119 based upon Japanese Patent Application No. 4-356302 filed Dec. 21, 1992.

This invention relates to improved lubricating oils having excellent characteristics in antiwear, especially in reducing wear of valve train system. It especially relates to internal combustion engine lubricating oils, and additives and additives mixtures employable for the preparation of such lubricating oils.

BACKGROUND OF THE INVENTION

Automobile spark ignition and diesel engines have valve train systems, including valves, cams and rocker arms which present special lubrication concerns. It is extremely important that the lubricant, i.e. the engine oil, protects these parts from wear. Further, it is important for engine oils to suppress the production of deposits in the engines. Such deposits are produced from non-combustibles and incomplete combustibles of hydrocarbon fuels (e.g., gasoline, diesel fuel oil) and by the deterioration of the engine oil employed.

Engine oils use a mineral oil or a synthetic oil as a base oil. However, simple base oils alone do not provide the necessary properties to provide the necessary wear protection, deposit control, etc. required to protect internal combustion engines. Thus, base oils are formulated with various additives, for imparting auxiliary functions, such as ashless dispersants, metallic detergents (i.e., metal-containing detergents), antiwear agents, antioxidants (i.e., oxidation inhibitors), viscosity index improvers and the like to give a compounded oil (i.e., a lubricating oil composition).

A number of such engine oil additives are known and employed in practice. Zinc dithiophosphates, for example, are contained in most all of the commercially available internal composition engine oils, especially those used for automobiles because of their favorable characteristics as an antiwear agent and performance as an oxidation inhibitor.

U.S. Pat. No. 4,201,684 discloses using lubricating oils containing sulfurized fatty acid amides, sulfurized fatty acid esters, or ester-amides of alkoxylated amines, such as diethanolamine. Other additives in the oils include zinc dithiophosphate, metal or sulfurized phenates, and metal hydrocarbyl sulfonates.

U.S. Pat. No. 4,394,276 discloses using lubricating oils containing sulfur-containing alkane diols as friction reducing agents. In one embodiment, the oils also contain a metal hydrocarbyl sulfonate, a metal phenate, a zinc dithiophosphate, and a borated alkenyl succinimide or succinate or mixtures thereof.

U.S. Pat. No. 4,394,277 discloses using lubricating oils containing borated sulfur-containing 1,2-alkane diols as friction reducing agents. In one embodiment, the oils also contain a metal hydrocarbyl sulfonate, a metal phenate, a zinc dithiophosphate, and a borated alkenyl succinimide or succinate or mixtures thereof.

U.S. Pat. No. 4,505,829 discloses using lubricating oils containing a polycarboxylic acid-glycol ester, an oil-soluble alkenyl succinimide or borated alkenyl succinate, and either a metal hydrocarbyl sulfonate, a metal phenate, a sulfurized phenate, or a zinc dithiophosphate.

U.S. Pat. Nos. 4,563,293 and 4,629,576 disclose using lubricating oils containing borated long-chain 1,2-alkane diols as friction reducing agents. The oils also contain a metal hydrocarbyl sulfonate, a metal phenate, a zinc dithiophosphate, and a borated alkenyl succinimide or succinate or mixtures thereof.

U.S. Pat. No. 3,933,659 discloses lubricating oil composition which comprise a major amount of an oil of lubricating viscosity, and an effective amount of each of the following: (1) an alkenyl succinimide, (2) a Group II metal salt of a dihydrocarbyl dithiophosphoric acid, (3) a compound selected from the group consisting of (a) fatty acid esters of dihydric and other polyhydric alcohols, and oil soluble oxyalkylated derivatives thereof, (b) fatty acid amides of low molecular weight amino acids, (c) N-fatty alkyl-N,N diethanol amines, (d) N-fatty alkyl-N,N-di(ethoxyethanol) amines, (e) N-fatty alkyl-N,N-dipoly(ethoxy) ethanol amines, and (f) mixtures thereof, and (4) a basic sulfurized alkaline earth metal alkyl phenate. Such lubricating compositions are useful as functional fluids in systems requiring fluid coupling, hydraulic fluid and/or lubrication of relatively moving parts, particularly as automatic transmission fluids.

U.S. Pat. No. 4,032,461 discloses using a lubricating oil composition having a boron derivative of alkyenylsuccinic acid imide, zinc dithiophosphate, calcium alkylbenzene-sulfonate, and sulfurized oxymetal dithiocarbamate.

U.S. Pat. No. 4,960,528 discloses using in an engine crankcase a formulated motor oil containing a small amount of the combination of (i) an overbased alkaline earth metal sulfonate, (ii) a zinc dihydrocarbyl dithiophosphate, (iii) a sulfurized carboxylic acid ester, and (iv) a sulfurized fatty acid amide, ester or ester-amide of an oxyalkylated amine or mixtures thereof.

The use of dithiocarbamates in lubricating oils is well known in the art.

U.S. Pat. No. 3,876,550 discloses lubricating compositions containing an alkylene bis(dithiocarbamate), as an antioxidant, and a substituted succinic acid as a rust inhibitor. The alkylene dithiocarbamate is represented in the patent by the formula $R^1R^2N—C(S)—S\text{-alkylene-}S—C(S)—NR^3R^4$. Example 5 of the patent describes a crankcase lubricant containing a viscosity improver, an ashless dispersant and methylene bis(dibutyldithiocarbamate). The patent further teaches that the composition may also contain various other additives, for example, detergents, dispersants, viscosity improvers, extreme pressure agents, antiwear additives, etc., as well as other oxidation inhibitors and corrosion inhibitors and cites an extensive list of extreme pressure agents, corrosion inhibitors and antioxidants, including zinc salts of phosphorodithoic acid.

U.S. Pat. No. 4,529,526 discloses the use of a sulfurized oxymetal dithiocarbamate with a boron derivative of alkyenylsuccinic acid imide, zinc dithiophosphate, and calcium alkylbenzene-sulfonate.

The use of methylene bis(dibutyldithiocarbamate) as an oxidation inhibitor in lubricating oils, in combination with other ingredients, is also disclosed in U.S. Pat. Nos. 4,125,479 and 4,880,551.

U.S. Pat. No. 4,879,054 is directed to cold temperature greases and teaches using dithiocarbamates such as Vanlube 7723, i.e., 4,4'-methylene bis(dithiocarbamate), in such greases to provide extreme pressure antiwear properties. Examples 13–18 describe using Vanlube 7723 and triarylphosphate as replacements for lead naphthenate and zinc dithiophosphate.

The use of dithiocarbamates as extreme pressure antiwear additives is also taught by U.S. Pat. No. 4,859,352, and U.S. Pat. No. 4,648,985 teaches that the combination of dithiocarbamates with zinc dithiophosphate and copper salts of carboxylic acid provide lubricants with extreme pressure properties.

U.S. Pat. No. 4,383,931 discloses using lubricating oils containing an oil-soluble molybdenyl bis-β-diketonate in combination with zinc dithiophosphate. Methylene bis (dihydrocarbyldithiocarbamates) are used as ashless antioxidants and extreme pressure agents.

U.S. Pat. No. 4,501,678 discloses using lubricating oils containing an alkyl thiocarbamoyl compound and either a molybdenum thiocarbamoyl compound or a molybdenum organophosphorodithioate.

U.S. Pat. No. 4,609,480 discloses using lubricating oils containing an alkyl thiocarbamoyl compound and a 1,3,4-thiadiazole compound. The oils can also contain, among other things, sulfurized oxymolydenum organophosphorodithioates.

A problem has arisen with respect to the use of zinc dithiophosphate, because phosphorous derivatives poison catalyst components of catalytic converters. This is a major concern, because effective catalytic converters are needed to reduce pollution and to meet governmental regulation designed to reduce toxic gases, such as hydrocarbons, carbon monoxide, and nitrogen oxides, in internal combustion engine exhaust emission. Such catalytic converters generally use a combination of catalytic metals, such as platinum or variations, and metal oxides and are installed in the exhaust streams, e.g., the exhaust pipes of automobiles, to convert the toxic gases to nontoxic gases. As before mentioned these catalyst components are poisoned by the phosphorous component, or the phosphorous decomposition products of the zinc dithiophosphate; and accordingly, the use of engine oils containing phosphorous additives may substantially reduce the life and effectiveness of catalytic converters. Therefore, it would be desirable to reduce the phosphorous content in the engine oils so as to maintain the activity and extend the life of the catalytic converter.

There is also governmental and automotive industry pressure towards reducing phosphorous content; for example, United States Military Standards MIL-L-46152E and the ILSAC Standards defined by the Japanese and United States Automobile Industry Association require engine oils to have phosphorous content below 0.12 wt. %. The phosphorous content in most high grade engine oils containing zinc dithiophosphate is approximately 0.1 wt. %, and thus meet the 0.12 wt. % requirement. Nevertheless, it would be desirable to decrease the amount of zinc dithiophosphate in lubricating oils still further, thus reducing catalyst deactivation and hence increasing the life and effectiveness of catalytic converters. However, simply decreasing the amount of zinc dithiophosphate presents problems because this necessarily lowers the antiwear properties and oxidation inhibition properties of the lubricating oil.

Meanwhile, recent engines installed in motor cars are apt to be used to satisfy severe demands (high speed and/or high power) and the viscosity of engine oils tends to be more and more lowered to reduce viscous resistance in order to improve fuel-efficiency. For these reasons, conditions concerning lubrication of engines are becoming severer and severer, and therefore the antiwear property of engine oils is becoming more and more important. However, the known engine oils, which contain detergent-dispersant and zinc dithiophosphate as main additive components, can not satisfactorily prevent engine troubles caused by wear. Therefore, it is desired to take measures to meet this problem.

SUMMARY OF THE INVENTION

The present invention provides a low-phosphorous lubricating oil composition for internal combustion engines that shows high antiwear performance in spite of low viscosity. That composition has a major amount of a base oil of lubricating viscosity, from 0.5 to 20 wt. % of metal-containing detergent, from 0.1 to 3 wt. % of zinc dithiophosphate, from 0.5 to 15 wt. % of boron-containing ashless dispersant, and from 0.01 to 3 wt. % of an antiwear agent, preferably from 0.05 to 2 wt. % antiwear agent. The antiwear agent has an aliphatic amide compound and either a dithiocarbamate compound or an ester derived from a fatty acid and boric acid.

Preferably, the zinc dithiophosphate is a secondary alkyl type.

Preferably, the boron-containing ashless dispersant comprises from 0.1 to 5 wt. % boron, more preferably from 0.2 to 2 wt. % boron. The preferred dispersant is a succinimide derivative.

Included within the broad definition of dithiocarbamate compounds are metal salts of dithiocarbamate compounds, such as zinc dithiocarbamate, copper dithiocarbamate, or molybdenum dithiocarbamate.

Also included within the broad definition of dithiocarbamate compounds are dithiocarbamate compounds having the formula:

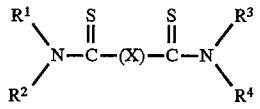

where $R^1$, $R^2$, $R^3$ and $R^4$ are the same or different and each represents an alkyl group of 1 to 18 carbon atoms, and (X) represents S, S—S, S—$CH_2$—S, S—$CH_2$—$CH_2$—S, S—$CH_2$—$CH_2$—$CH_2$—S, or S—$CH_2$—CH($CH_3$)—S. Preferably, $R^1$, $R^2$, $R^3$ and $R^4$ are independently selected from alkyl groups having 1 to 6 carbon atoms. More preferably, the dithiocarbamate compound is methylene bis(dibutyldithiocarbamate).

Preferably, the ester is derived from glycerol, boric acid and a fatty acid having 8–24 carbon atoms. That ester can have the following formulas:

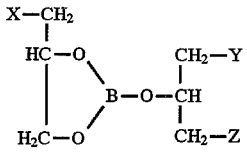

(I)

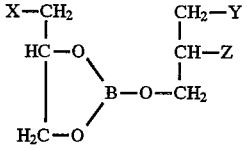

(II)

-continued

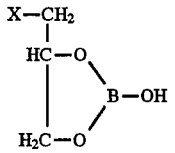

(III)

wherein X, Y and Z are the same or different and each represents a group selected from the group consisting of a hydroxyl group and an alkylcarboxyl group.

This invention can further involve an additive concentrate having 100 weight parts of a metal-containing detergent, from 10 to 700 weight parts of a boron-containing ashless dispersant, and from 1 to 200 weight parts of the antiwear agent described above.

It is an object of the present invention to provide an engine oil for motor cars of which phosphorus content in lowered, but of which antiwear property is not inferior to those of the known engine oils containing zinc dithiophosphate at a conventional high content level.

It is another object of the present invention to provide an engine oil for motor cars which shows high antiwear performance in spite of low viscosity.

DETAILED DESCRIPTION OF THE INVENTION

It has been found that the combination of an aliphatic amide compound with either a dithiocarbamate compound or an ester derived from a fatty acid and boric acid gives high antiwear performance in the presence of a boron-containing ashless dispersant.

The present invention resides in an engine oil composition comprising a metal-containing detergent, zinc dithiophosphate, a boron-containing ashless dispersant, and an antiwear agent having an aliphatic amide compound and either a dithiocarbamate compound or an ester derived from a fatty acid and boric acid.

A variety of metal-containing detergents, zinc dithiophosphate, boron-containing ashless dispersants and base oils are known. These known materials or their analogous compounds can be employed for the preparation of the engine oil of the invention. Further, viscosity index improvers are usually added to the engine oils in order to adjust viscosity. Representative examples of these materials are described below.

Metal-Containing Detergent

As the metal-containing detergent, a metal phenate or a metal sulfonate is generally employed. The metal phenate is an alkaline earth metal salt of sulfide of alkylphenol having an alkyl group of approx. 8–30 carbon atoms. Generally employed alkaline earth metals are calcium, magnesium and barium. The metal sulfonate is an alkaline earth metal salt of a sulfonated aromatic compound or a sulfonated mineral oil having a molecular weight of approx. 400–600. Generally employed alkaline earth metals are also calcium, magnesium and barium. The metal phenate and metal sulfonate can be used singly or in combination. Also employed are other metal-containing detergents such as salicylate, phosphonate and naphthenate of alkaline earth metals. These detergents can be employed single or in combination. The aforementioned phenate and sulfonate can be employed in combination with these other metal-containing detergents. The metal-containing detergents may be of a neutral type or of an over-based type having an alkalinity value of 150–300 or more.

The metal-containing detergent is generally incorporated into an engine oil in an amount of 0.5–20 wt. % per total amount of the engine oil.

Zinc Dithiophosphate

With respect to the zinc dithiophosphate, preferably used as an antiwear agent or an oxidation inhibitor is zinc dihydrocarbyldithiohosphate having an alkyl group of 3–18 carbon atoms or an alkylaryl group including an alkyl group of 3–18 carbon atoms. This agent is generally incorporated into an engine oil in an amount of 0.1–3 wt. % per total amount of the engine oil.

Boron-Containing Ashless Dispersants

Representative examples of boron-containing ashless dispersants are boron-containing compounds prepared by boration of succinimide, succinic ester, benzylamine and their derivatives each of which has an alkyl or alkenyl group of a molecular weight of approx. 700–3,000. A preferred amount of boron contained in these ashless dispersants is 0.1–5 wt. % (especially 0.2–2 wt.%). The particularly preferable boron-containing ashless dispersant is a succinimide derivative containing boron in an amount of 0.1–5 wt. %. The boron-containing ashless dispersant is generally incorporated into an engine oil in an amount of 0.5–15 wt. % per total amount of the engine oil. Needless to say, the boron-containing ashless dispersants can be use in combination with ashless dispersants containing no boron.

Viscosity Index Improver

Examples of the viscosity index improvers are poly-(alkyl methacrylate), ethylene-propylene copolymer, styrene-butadiene copolymer, and polyisoprene. Viscosity index improvers of dispersant type (having increased dispersancy) or multifunction type are also employed. These viscosity index improvers can be used singly or in combination. The amount of viscosity index improver to be incorporated into an engine oil varies with desired viscosity of the compounded engine oil, and generally in the range of 0.5–20 wt. % per total amount of the engine oil.

Base Oil

The base oil may be a mineral oil or synthetic oil or a blend of mineral oils and/or synthetic oils blended to give a base oil of the desired internal combustion engine oil viscosity. Typically, individually the oils used as its base oil will have a viscosity range of about from 10 to 120 cST at 40° C. and will be selected or blended depending on the desired end use and the additives in the finished oil to give the desired grade of engine oil.

Details of the aliphatic amide compound, the dithiocarbamate compound, and the ester compound which are added into the engine oil of the invention are described below.

Aliphatic Amide Compound

A preferred aliphatic amide compound used in the engine oil composition of the invention is an amide compound of a fatty acid having 8–24 (especially 12–20) carbon atoms or its derivative. Such fatty acid may be saturated or unsaturated, but an unsaturated fatty acid is preferable. Other functional groups can be included in the acid. Particularly preferable examples of the amide compound are oleic amide and oleic amide sulfide.

Dithiocarbamate Compound

The dithiocarbamate compound that can be used in the engine oil composition of the invention is an alkylthiocarbamoyl compound represented by the following formula:

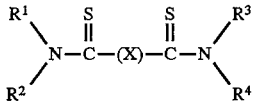

wherein $R^1$, $R^2$, $R^3$, and $R^4$ are the same or different and each represents an alkyl group of 1–18 carbon atoms, and (X) represents S, S—S, S—$CH_2$—S, S—$CH_2$—$CH_2$—S, S—$CH_2$—$CH_2$—$CH_2$—S, or S—$CH_2$—CH($CH_3$)—S. These are known compounds and can be prepared by known procedures, and in some cases have been employed as vulcanizing accelerators and as additives for gear oils and turbine oils and hence readily commercially available. Referring to the $R^1$, $R^2$, $R^3$, and $R^4$ groups, the alkyl group may be linear (straight chain) or branched chain and preferably have 1 through 10 carbon atoms, more preferably 1 through 6 carbon atoms. Typical alkyl groups include, for example, methyl, ethyl, propyl, n-butyl, isobutyl, pentyl, isopentyl, heptyl, octyl, 2-ethylhexyl, nonyl, decyl, and dodecyl. Typical examples of the thiocarbamate compounds of this formula are methylene bis(dibutyldithiocarbamate), bis(dimethylthiocarbamoyl)monosulfide, bis(dimethylthiocarbamoyl)disulfide, bis(dibutylthiocarbamoyl)disulfide, bis(diamyltiocarbamoyl) disulfide, and bis(dioctylthiocarbamoyl)disulfide.

Further, metal dithiocarbamates such as zinc dithiocarbamate, copper dithiocarbamate and molybdenum dithiocarbamate are also employable and it is particularly advantageous to use these metal dithiocarbamates. These compounds can be used singly or in combination of two or more compounds.

Ester Derived from a Fatty Acid and Boric Acid

The ester that can be used in the engine oil composition of the invention is an ester derived from a fatty acid and boric acid. A preferred example of such ester is an ester which is derived from glycerol, boric acid and a fatty acid having 8–24 carbon atoms and which is represented by one of the following formulae (I), (II) and (III):

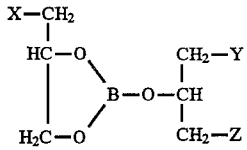

(I)

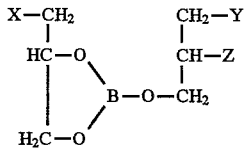

(II)

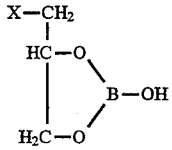

(III)

In the above formula (I), (II) and (III), X, Y and Z are the same or different and each represents hydroxyl group (—OH) or an alkylcarboxyl group (—OCOR: R represents an alkyl group of 7–23 carbon atoms of straight chain type or branched chain type and it may be saturated or unsaturated.)

The engine oil of the invention may contain various additional additives other than those described above, if desired. Examples of such additional additives include known oxidation inhibitors, extreme pressure agents, corrosion inhibitors, rust inhibitors, friction modifiers, antifoaming agents and pour point depressants. In addition to these additives, other antiwear agents and other multifunctional additives (e.g., organic molybdenum compounds such as molybdenum dithiophosphate) may be employed in combination.

In the preparation of the engine oil of the invention, the additives can be added to a base oil separately. However, the engine oil is preferably prepared by beforehand producing an additive composition comprising essential components which include a metal-containing detergent, a boron-containing ashless dispersant, zinc dithiophosphate, and the above-mentioned aliphatic amide compound (1) and/or dithiocarbamate compound (2), and optional components (generally dissolved or dispersed in a base oil at a high concentration); and then incorporating thus produced additive composition, a viscosity index improver and other optional components into a large amount of base oil. The additive composition is preferably prepared by mixing 100 weight parts of a metal-containing detergent, 10–700 weight parts of an ashless dispersant, and 1–200 weight parts of the aliphatic amide compound and/or the dithiocarbamate compound.

EXAMPLES

The invention will be further illustrated by following examples which set forth particularly advantageous method embodiments. While the Examples are provided to illustrate the present invention, they are not intended to limit it.

Various engine oils prepared from the same paraffinic mineral oil (viscosity index value: 100), viscosity index improver, pour point depressant, metal-containing detergent, zinc dithiophosphate and oxidation inhibitor; and various ashless dispersants and other additive components are set forth in Table 1. (The engine oil sample Nos. 3–4 are examples of the invention and the sample Nos. 1–2 and 5–8 are comparison examples. Every sample has a viscosity condition of SAE 5W30 and the phosphorus content of every sample is 0.08 wt. %.) With respect to wear of valve train system, the performances of these engine oil samples were evaluated by the following method.

According to Japanese Automobile Standards Organization (JASO) M328-91, bench scale monitoring test was performed in 1.5 litter, straight 4 cylinder, OHC gasoline engine (TOYOTA type-3A) from which pistons and connecting rods had been beforehand detached. After the engine was worked by an electric motor at 1000±50 r.p.m. at 60°–65° C. (oil temperature) for 200 hours, degree of scuffing (rated by scuffed area) occurring on the rocker arm pad (the face where the cam meets the rocker follower) was evaluated and presented in the form of demerit grading points 0–100 (i.e., the value of 0 means the best and the value of 100 means the worst performance).

TABLE I

| Engine oil samples | No. 1 | No. 2 | No. 3 | No. 4 | No. 5 | No. 6 | No. 7 | No. 8 |
|---|---|---|---|---|---|---|---|---|
| Ashless dispersant I | — | — | — | — | 5.0 | 5.0 | 5.0 | — |
| Boron-containing ashless dispersant II | 5.0 | 5.0 | 5.0 | 5.0 | — | — | — | 5.0 |
| Metal-containing detergent | 2.7 | 2.7 | 2.7 | 2.7 | 2.7 | 2.7 | 2.7 | 2.7 |
| Zinc dithiophosphate | 1.1 | 1.1 | 1.1 | 1.1 | 1.1 | 1.1 | 1.1 | 1.1 |
| Oxidation inhibitor | 1.0 | 1.0 | 1.0 | 1.0 | 1.0 | 1.0 | 1.0 | 1.0 |
| Aliphatic amide compound | 0.5 | — | 0.2 | 0.2 | — | 0.5 | — | — |
| Dithiocarbamate compound | — | 0.5 | — | 0.3 | — | — | 0.5 | — |
| Boric ester | — | — | 0.3 | — | — | — | — | — |
| Viscosity index improver | 7.7 | 7.7 | 7.7 | 7.7 | 7.7 | 7.7 | 7.7 | 7.7 |
| Pour point depressant | 0.5 | 0.5 | 0.5 | 0.5 | 0.5 | 0.5 | 0.5 | 0.5 |
| Paraffinic mineral oil | 81.5 | 81.5 | 81.5 | 81.5 | 82.0 | 81.5 | 81.5 | 82.0 |
| Valve train system motoring test (grading point) | 1.4 | 2.8 | 0 | 0 | 73 | 26 | 31 | 11 |

Further, other supplemental additives such as antifoaming agent were added when they were required. Details of the additives set forth in Table 1 are as follows:

Ashless dispersant I: Succinic imide

Boron-containing ashless dispersant II: Boric acid-modified succinic imide (content of boron: 0.4 wt. %)

Metal, containing detergent: Mixture of calcium sulfonate and calcium phenate

Zinc dithiophosphate: Zinc dihydrocarbyl-dithiophosphate (of secondary alkyl type having 4–6 carbon atoms; content of phosphorus: 7.2 wt. %)

Oxidation inhibitor: Mixture of dialkyldiphenyl amine and hindered phenol

Aliphatic amide compound: Oleic amide

Dithiocarbamate compound: Molybdenum dithiocarbamate

Boric ester: Mixture of the compounds represented by the above formulae (I) and (II) (at least one of X, Y and Z is oleic acid residue, and the others are hydroxyl groups). The mixture contains about 1 mole of oleic acid residue and 2 mole of glycerin residue per 1 mole of boric acid residue.

Viscosity index improver: Ethylene-propylene copolymer derivative (dispersant type)

Pour point depressant: Polyalkylmethacrylate

Paraffinic mineral oil: 100-Neutral oil having viscosity index value of 100

As is clear from the test data set forth in Table 1, the engine oil of the present invention, which is prepared by incorporating a boron-containing ashless dispersant in combination with an aliphatic amide compound and with either an dithiocarbamate compound or an ester derived from a fatty acid and boric acid, shows high antiwear performance against wear of valve train system.

The engine oil of the present invention, which is prepared by incorporating a metal-containing detergent, zinc dithiophosphate (zinc dithiophosphate), a boron-containing ashless dispersant, and an aliphatic amide compound and with either an dithiocarbamate compound or an ester derived from a fatty acid and boric acid into lubricating base oil, shows high antiwear performance against wear of valve train system, in spite of comparatively low phosphorus content and viscosity.

While the present invention has been described with reference to specific embodiments, this application is intended to cover those various changes and substitutions that may be made by those skilled in the art without departing from the spirit and scope of the appended claims.

What is claimed is:

1. A low-phosphorous lubricating oil composition for internal combustion engines comprising:

(a) a major amount of a base oil of lubricating viscosity, (b) from 0.5 to 20 wt. % of metal-containing detergent, (c) from 0.1 to 3 wt. % of a secondary zinc dithiophosphate, (d) from 0.5 to 15 wt. % of boron-containing ashless dispersant, and (e) from 0.05 to 2 wt. % of an antiwear agent comprising:

(i) an oleic amide, and (ii) a compound selected from the group consisting of:

(1) a molybdenum dithiocarbamate, and (2) an ester derived from glycerol, boric acid, and a fatty acid having 8–24 carbon atoms, wherein the ester is selected from the group consisting of:

(a) an ester having the formula:

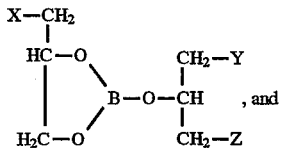

(I)

(b) an ester having the formula:

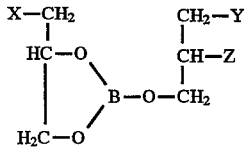

(II)

wherein X, Y, and Z are the same or different and each represents a group selected from the group consisting of a hydroxyl group and an alkylcarboxyl group.

2. A low-phosphorous lubricating oil composition according to claim 1 wherein the boron-containing ashless dispersant comprises 0.1 to 5 wt. % boron.

3. A low-phosphorous lubricating oil composition according to claim 2 wherein the boron-containing ashless dispersant comprises 0.2 to 2 wt. % boron.

4. A low-phosphorous lubricating oil composition according to claim 1 wherein the boron-containing ashless dispersant is a succinimide derivative that comprises 0.1 to 5 wt. % boron.

5. A low-phosphorous lubricating oil composition for internal combustion engines comprising:

(a) a major amount of a base oil of lubricating viscosity, (b) from 0.5 to 20 wt. % of metal-containing detergent, (c) from 0.1 to 3 wt. % of zinc dithiophosphate, (d) from 0.5 to 15 wt. % of boron-containing ashless dispersant, and (e) from 0.05 to 2 wt. % of an antiwear agent comprising:
(i) an oleic amide, and
(ii) a molybdenum dithiocarbamate.

6. A low-phosphorous lubricating oil composition for internal combustion engines comprising:

(a) a major amount of a base oil of lubricating viscosity, (b) from 0.5 to 20 wt. % of metal-containing detergent, (c) from 0.1 to 3 wt. % of a secondary alkyl zinc dithiophosphate, (d) from 0.5 to 15 wt. % of boron-containing ashless dispersant, wherein the boron-containing ashless dispersant is a succinimide derivative that comprises 0.2 to 2 wt. % boron, and (e) from 0.05 to 2 wt. % of an antiwear agent comprising:
(i) an oleic amide, and
(ii) an ester derived from glycerol, boric acid and a fatty acid having 8 to 24 carbon atoms, wherein the ester is selected from the group consisting of:
(1) an ester having the formula:

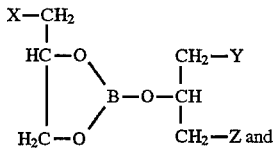

(I)

(2) an ester having the formula:

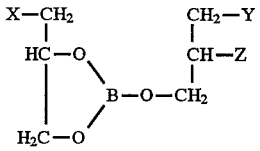

(II)

wherein X, Y, and Z are the same or different and each represents a group selected from the group consisting of a hydroxyl group and an alkylcarboxyl group.

7. An additive concentrate comprising:

(a) 100 weight parts of a metal-containing detergent, (b) from 10 to 700 weight parts of a boron-containing ashless dispersant, (c) from 1 to 200 weight parts of an antiwear agent comprising:
(i) an oleic amide, and
(ii) a compound selected from the group consisting of:
(1) a molybdenum dithiocarbamate, and
(2) an ester derived from glycerol, boric acid, and a fatty acid having 8–24 carbon atoms, wherein the ester is selected from the group consisting of:
(a) an ester having the formula:

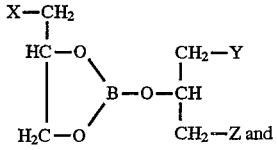

(I)

(b) an ester having the formula:

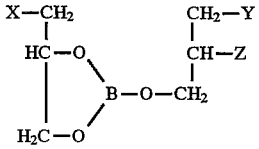

(II)

wherein X, Y, and Z are the same or different and each represents a group selected from the group consisting of a hydroxyl group and an alkylcarboxyl group, (d) a secondary alkyl zinc dithiophosphate, and (e) a base oil.

8. An additive concentrate according to claim 7 wherein the boron-containing ashless dispersant comprises 0.1 to 5 wt. % boron.

9. An additive concentrate according to claim 8 wherein the boron-containing ashless dispersant comprises 0.2 to 2 wt. % boron.

* * * * *